United States Patent [19]

Eberhardt

[11] Patent Number: 4,720,050

[45] Date of Patent: Jan. 19, 1988

[54] COMMINUTOR-PUMP ASSEMBLY

[75] Inventor: H. Alfred Eberhardt, Paoli, Pa.

[73] Assignee: Hale Fire Pump Company, Conshohocken, Pa.

[21] Appl. No.: 389,676

[22] Filed: Jun. 18, 1982

[51] Int. Cl.[4] ..... B02C 23/36

[52] U.S. Cl. ..... 241/46.06; 241/79.3; 241/87; 241/93; 241/101.2; 241/222; 241/243

[58] Field of Search ..... 241/79.3, 91, 222, 243, 241/300.1, 46.06, 46.15, 46.08, 93, 87, 101.2, 292.1, 293, 294, 32

[56] References Cited

U.S. PATENT DOCUMENTS

| | | | |
|---|---|---|---|
| 909,914 | 1/1909 | Langdon . | |
| 2,462,542 | 2/1949 | Paetow | 241/32 X |
| 2,919,075 | 12/1959 | Pfeiffer | 241/32 X |
| 2,931,363 | 4/1960 | Bulin | 241/32 X |
| 3,360,024 | 12/1967 | Traben | 241/293 X |
| 3,481,235 | 12/1969 | Kaufman et al. | 241/32 X |
| 4,378,093 | 3/1983 | Keener | 241/46.06 X |

FOREIGN PATENT DOCUMENTS

| | | | |
|---|---|---|---|
| 706062 | 3/1954 | United Kingdom | 241/46.06 |

*Primary Examiner*—P. W. Echols
*Assistant Examiner*—Joseph M. Gorski
*Attorney, Agent, or Firm*—Frank A. Follmer

[57] ABSTRACT

A comminutor and a pump are assembled together so that they are driven by the same prime mover, such as a tractor power take-off, the pump being arranged to draw liquid, such as sewage, into a comminution chamber containing a rotating hollow cylinder which functions as a combination cutter and strainer. The solids in the sewage are comminuted until they are of a size small enough to pass through openings in the cylinder into the interior thereof from which the comminuted particles are pumped to a desired location, such as an irrigated field by the pump. The pump shaft has a drive shaft extension that extends through the center of the rotating cylinder to drive a planetary gear system arranged so that the rotating cylinder is driven at a speed much less than the pump speed.

14 Claims, 11 Drawing Figures

2
14
10
13
40
22
112
99
98
104
100
18
20
110
100
100
98
23
2

92
94
94
38
39
88
36
86
90
80
40
6
6
41
41
16
13
37
82
83
30
85
84
14
104
56
98
50
32
26
98
12
120
120
120
24
100
34
52
34
5
5
49
48
106
11
10
45
46
58
49
62
28
44
45
66
64
4
4
70
68
60
3
3
74
72
76

FIG. 10
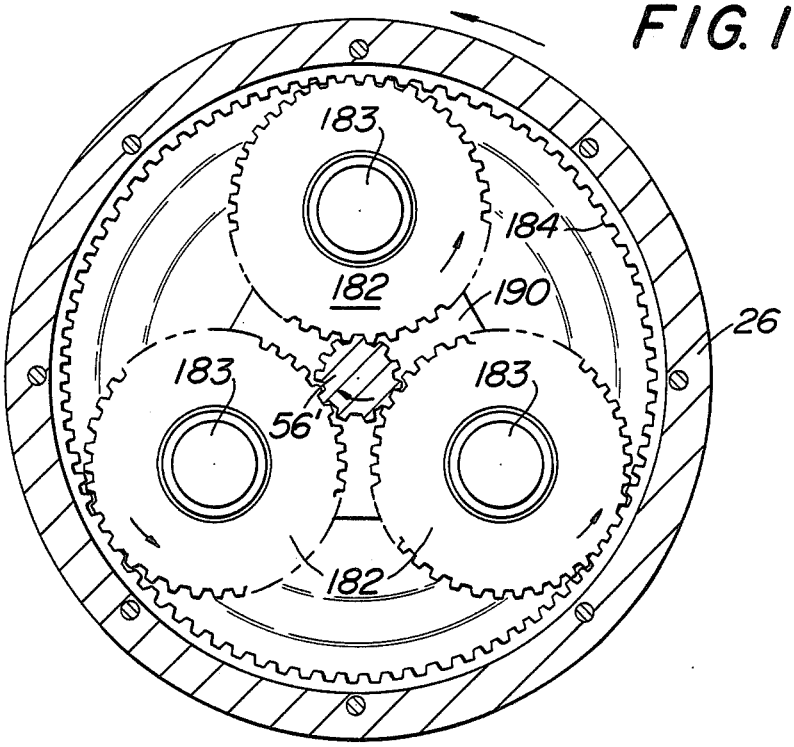
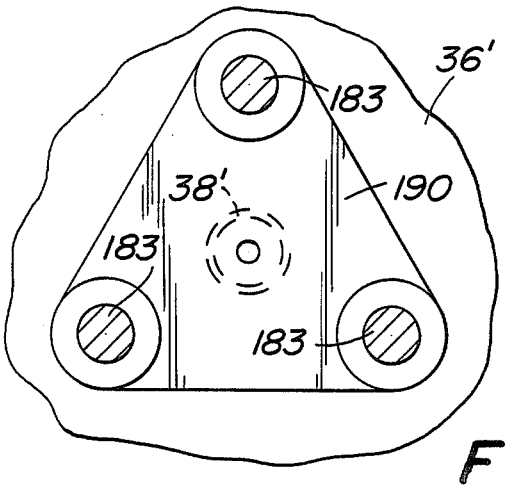
FIG. 11

COMMINUTOR-PUMP ASSEMBLY

BACKGROUND AND SUMMARY OF THE INVENTION

This invention relates to a comminutor-pump assembly of a type suitable for use, for example, in a system for the application of livestock waste to land by irrigation. These systems are becoming increasingly popular because of the low cost and the ease of use thereof as compared with other systems. However, irrigation systems of this type require reliable means for reducing the size of the solids so as to avoid clogging of the centrifugal pump and the openings in the sprinkler heads or large guns used to spray the sewage and other solids out onto the field. It is also essential to maintain sufficient pumping pressure in the system.

The comminutor-pump assembly of the invention is constructed and arranged to achieve reliable comminution and to maintain a high pumping pressure. To these ends, the comminutor-pump assembly of the invention is constructed so that the comminutor and the pump are driven by the same prime mover, the pump being arranged to draw the sewage into a comminution chamber containing a rotating hollow cylinder which functions as a combination cutter and strainer. The solids in the sewage are comminuted to a size small enough to pass through openings in the rotating cylinder into the interior thereof from which the comminuted particles are pumped to the irrigation spraying location by the pump. The pump shaft has a drive shaft extension which extends through the center of the rotating cylinder to drive a planetary gear system arranged so that the rotating cylinder is driven at a speed much less than the pump speed.

Another feature of the invention is the provision of large cutting teeth, each of which is provided with a plurality of smaller teeth to utilize a grinding action in the comminution of the solids. Also, the teeth are distributed around the exterior of the comminutor drum to cooperate with cutting blades in the comminution chamber so as to maintain a relatively steady cutting action to thereby avoid intermittent surges in power requirements.

BRIEF DESCRIPTION OF THE DRAWINGS

FIG. 10 is a section taken on line 10—10 of FIG. 9.

FIG. 11 is a section taken on line 11—11 of FIG. 9.

DETAILED DESCRIPTION OF THE PREFERRED EMBODIMENT

Figure 1:
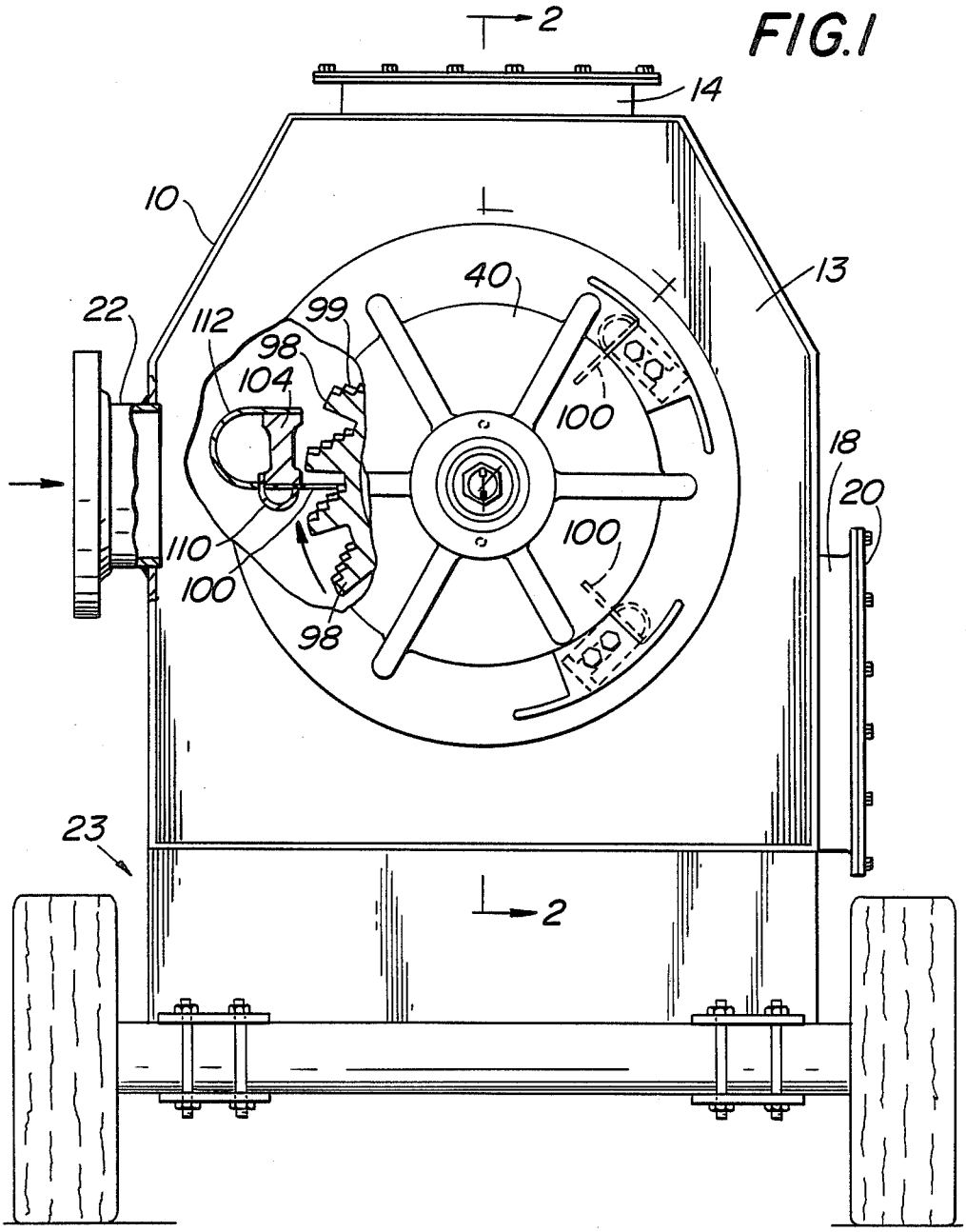
FIG. 1 is a side elevation of a comminutor-pump assembly in accordance with the invention.

The comminutor-pump assembly of the invention comprises a main housing 10 having a box-like shape and defining a comminution chamber 12 therein. Housing 10 has a top access opening 14 provided with a cover 16, a side access opening 18 provided with a cover 20, and an inlet means 22 in a side wall providing a passage through which the sewage enters comminution chamber 12 (See the arrow in FIG. 1). Housing 10 is supported on a transportable cart means 23.

Figure 2:
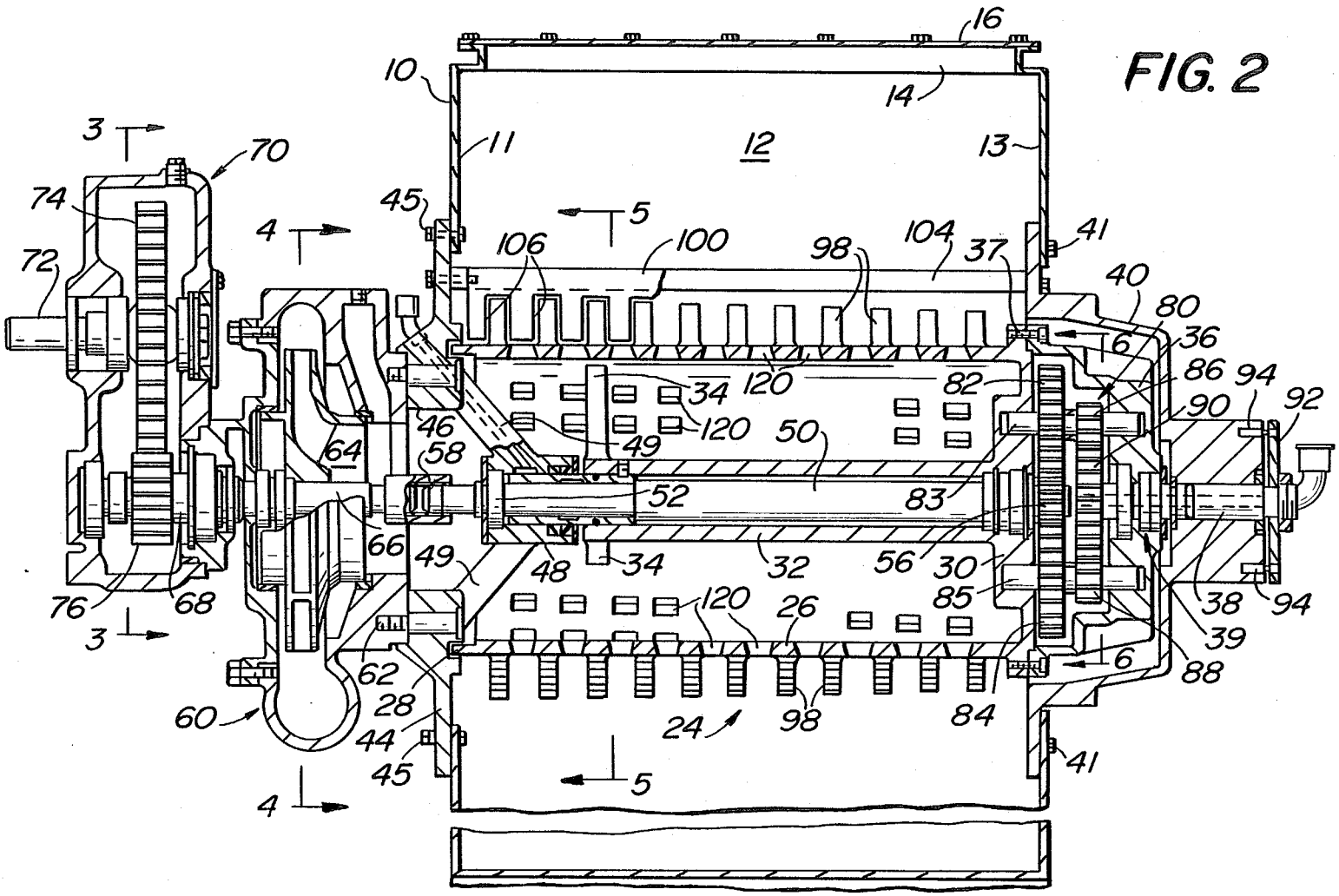
FIG. 2 is a section taken on line 2—2 of FIG. 1.
Figure 3:
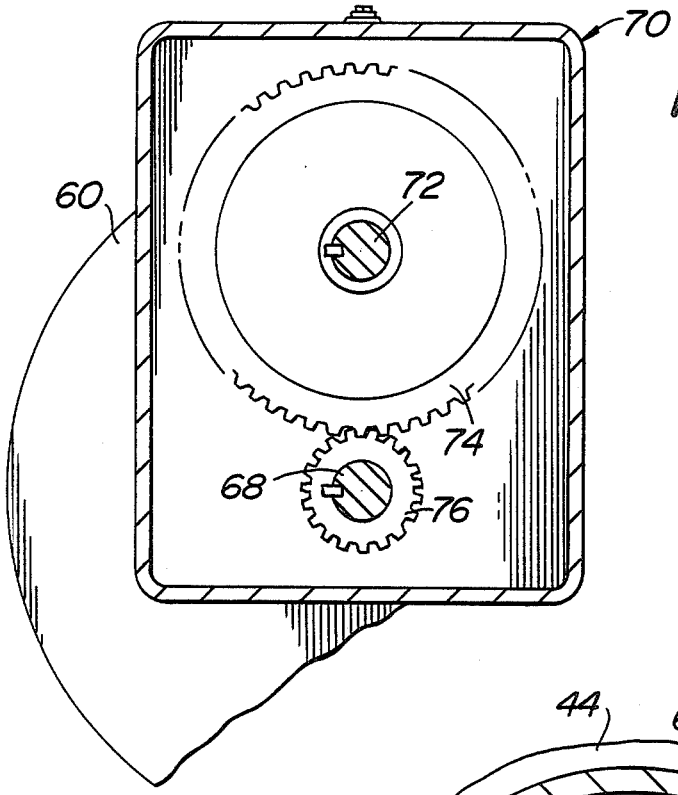
FIG. 3 is a section taken on line 3—3 of FIG. 2.

The assembly comprises a comminutor drum 24 in the form of a hollow cylinder 26 which, as shown in FIG. 2, has an open end 28 and is closed at its opposite end by an end wall 30. A tubular support 32 extends from end wall 30 axially along the center of hollow cylinder 26. Four spokes 34 extend radially between the extended end of tubular support 32 and the internal wall of hollow cylinder 26 to provide a rigid drum structure.

Comminutor drum 24 is mounted to extend horizontally across comminutor chamber 12 between the side walls 11 and 13 thereof and for rotation about its longitudinal horizontal axis. To this end, the closed end of hollow cylinder 26 has a drum cover 36 mounted thereon by means of bolts 37. Drum cover 36 is rotatively supported on a shaft 38 by means of suitable bearings 39. Shaft 38 is mounted on an end support 40 secured to side wall 13 by bolts 41. Drum cover 36 cooperates with end wall 30 to define a chamber containing a planetary gear system which drives comminutor drum 24 in a manner to be described hereafter.

A pump inlet adapter 44 is mounted on side wall 11 by means of bolts 45. Adapter 44 has a central opening 46 and a centrally located hollow cylindrical hub 48 supported by three radially extending spokes 49. A drive shaft extension 50 extends through hub 48, through tubular support 32, and through an opening in end wall 30 into the gear containing chamber defined by drum cover 36 on the outside of end wall 30. Shaft extension 50 is supported for rotation in suitable bearing means 52 in hub 48 and bearing means 54 in end wall 30, as is shown in FIG. 2.

At its one end shaft extension 50 has engaged thereon a drive gear 56 for the planetary gear system located within the chamber defined by drum cover 36 and at its other end shaft extension 50 is engaged in a coupling 58.

By this arrangement, hollow cylinder 26 is mounted for rotation about its horizontal axis which is also aligned with the axis of shaft extension 50 and shaft 38. As is shown in FIG. 2, open end 28 of hollow cylinder 26 is received within a circular groove in adapter 44 with a close fit so as to minimize leakage from comminution chamber 12 past this open end 28.

As will be described hereafter, shaft 38 is engaged with the planetary gear system and is normally held against rotation. However, when cylinder 26 is jammed against rotation, shaft 38 functions as an output shaft for the planetary gear system and rotates.

Figure 4:
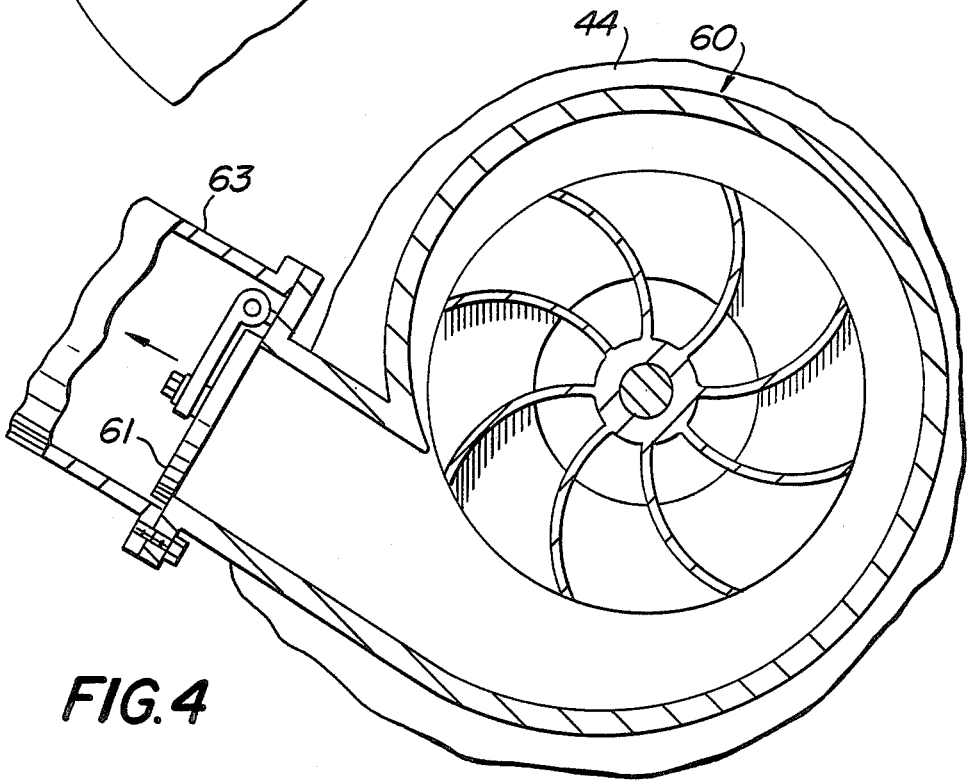
FIG. 4 is a section taken on line 4—4 of FIG. 2.

A centrifugal pump 60 is mounted on the outer side of adapter 44 by mounting bolts 62 with the pump suction inlet 64 in communication with the interior of hollow cylinder 26 through circular opening 46 of adapter 44 as shown in FIG. 2. The discharge of pump 60 is closed by a check valve means 61 (FIG. 4). The drive shaft 66 of pump 60 has its extended end engaged within coupling 58 and its other end in engagement with the output shaft 68 of a step-up gearbox 70. The input shaft 72 of gearbox 70 is adapted to be driven by means such as the power take-off of a tractor or the like. Gearbox 70 comprises a large gear 74 and a small gear 76 constructed and arranged to step-up the RPM to a suitable speed for driving the centrifugal pump 60. It is to be noted that as pump shaft 66 is driven from the output shaft 68 of gearbox 70, the shaft extension 50 will be rotated at the same speed through the coupling 58.

Figure 6:
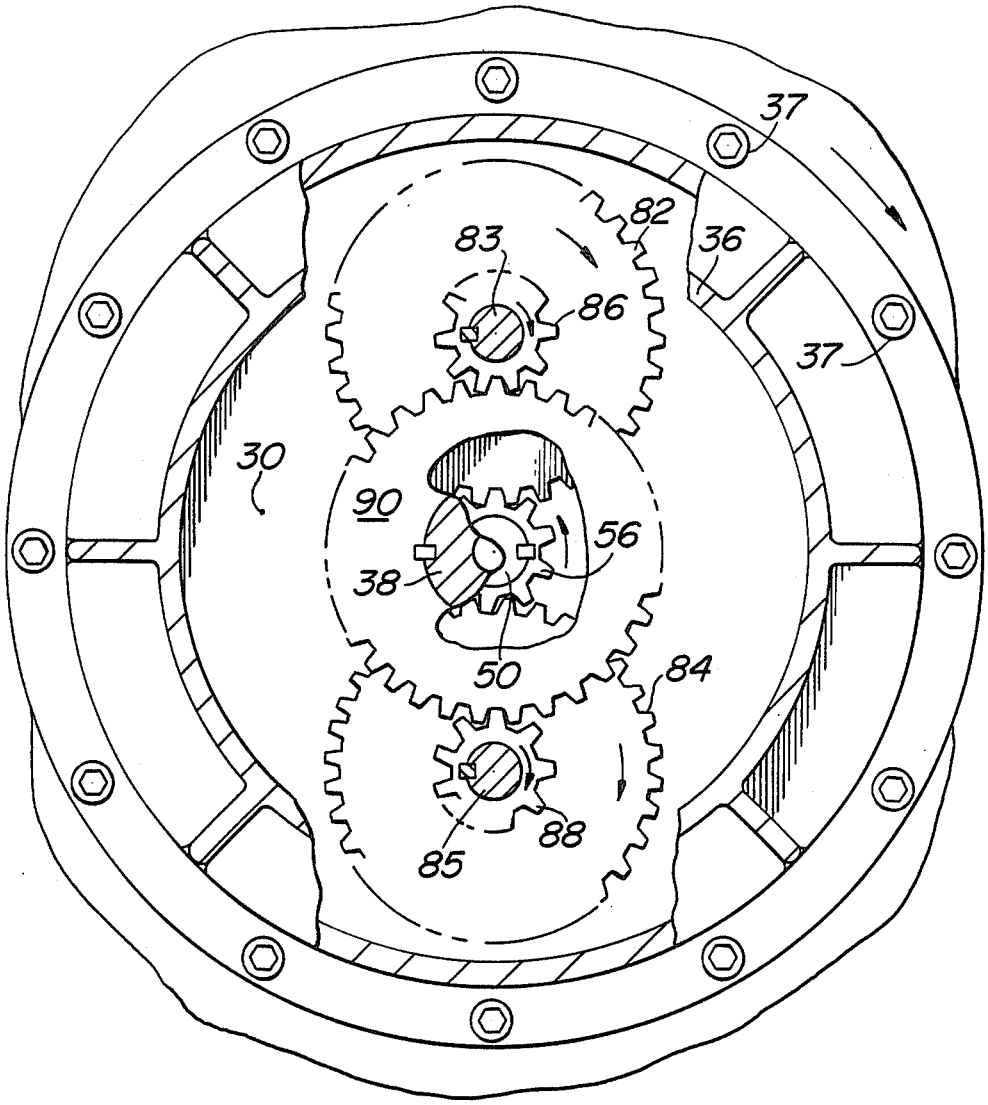
FIG. 6 is a section taken on line 6—6 of FIG. 2.

There is provided a planetary gear system 80 which is contained within the chamber defined by drum cover 36 and which is responsive to the rotation of shaft extension 50 to cause the hollow cylinder 26 to rotate at a reduced speed. Referring to FIGS. 2 and 6, planetary gear system 80 comprises small central pinion gear 56 engaged on the end of shaft extension 50 and a pair of large planet gears 82 and 84 engaged with gear 56 at diametrically opposed locations thereof. Gears 82 and 84 are mounted on and keyed to horizontal shafts 83 and 85, respectively. Shafts 83 and 85 also have keyed thereon a pair of small planet gears 86 and 88, respectively, and are rotatably mounted in opposed cylindrical bores in end wall 30 and drum cover 36 as shown in FIG. 2. Gears 86 and 88 are arranged at diametrically opposed locations in engagement with a normally locked sun gear 90 keyed on the end of shaft 38. Shaft 38 is locked against rotation by means of a plate 92 keyed on its outer end and held against rotation by a pair of shear pins 94.

In operation, planetary gear system 80, in response to rotation of gear 56 by shaft extension 50, causes large planetary gears 82 and 84 to revolve around gear 56 and small planetary gears 86 and 88 to revolve around sun gear 90. This gear revolving movement causes shafts 83 and 85 to revolve around the horizontal axis of hollow cylinder 26. With the gears 56, 82, 84, 86 and 88 rotating in the direction of the arrows in FIG. 6, shafts 83 and 85 move in a clockwise direction around gear 56 causing a corresponding clockwise rotation of hollow cylinder 26 as shown by the large arrow in FIG. 6.

It is the rotation of hollow cylinder 26 that provides the movement for producing the comminution of the solids in comminution chamber 12. To this end, the hollow cylinder 26 is provided with a plurality of cutting teeth 98 which cooperate with three cutting blades 100 spaced circumferentially around the circumference of hollow cylinder 26 for achieving the comminution of solids within comminution chamber 12.

Figure 7:
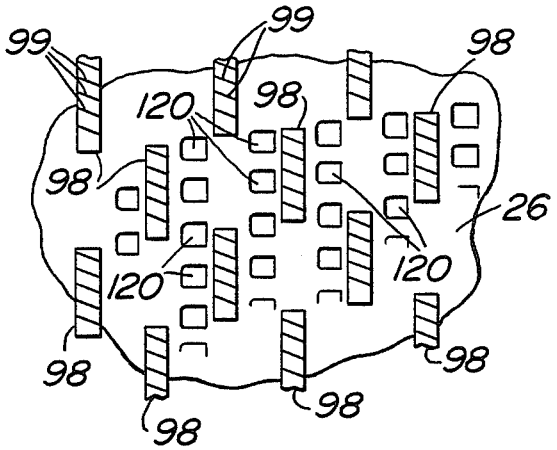
FIG. 7 is a fragmentary detail view showing the cutting teeth arrangement.
Figure 8:
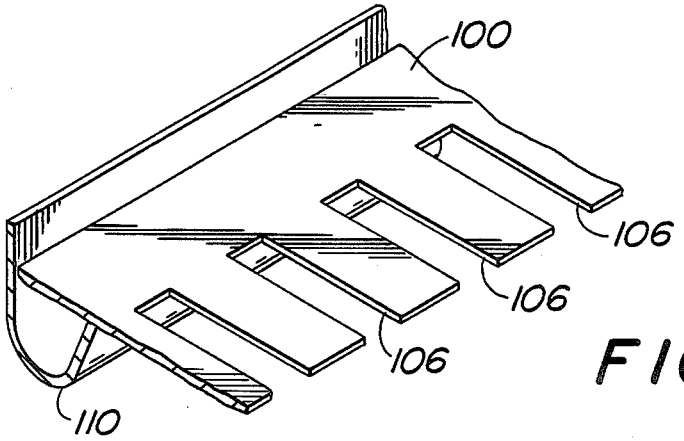
FIG. 8 is a fragmentary detail view showing the blade construction.

Cutting teeth 98 are arranged in eleven circular rows extending circumferentially around the external wall of hollow cylinder 26, and as shown in FIG. 7, teeth 98 are spaced apart along the circumferential rows with the teeth on each row being staggered in relation to the teeth in adjacent rows. Also, the teeth 98 in alternate circular rows are arranged in longitudinal rows set back progressively in the circumferential direction. This set back arrangement results in the progressive engagement of the teeth 98 with the cutting blades 100 as will be described hereafter.

Figure 5:
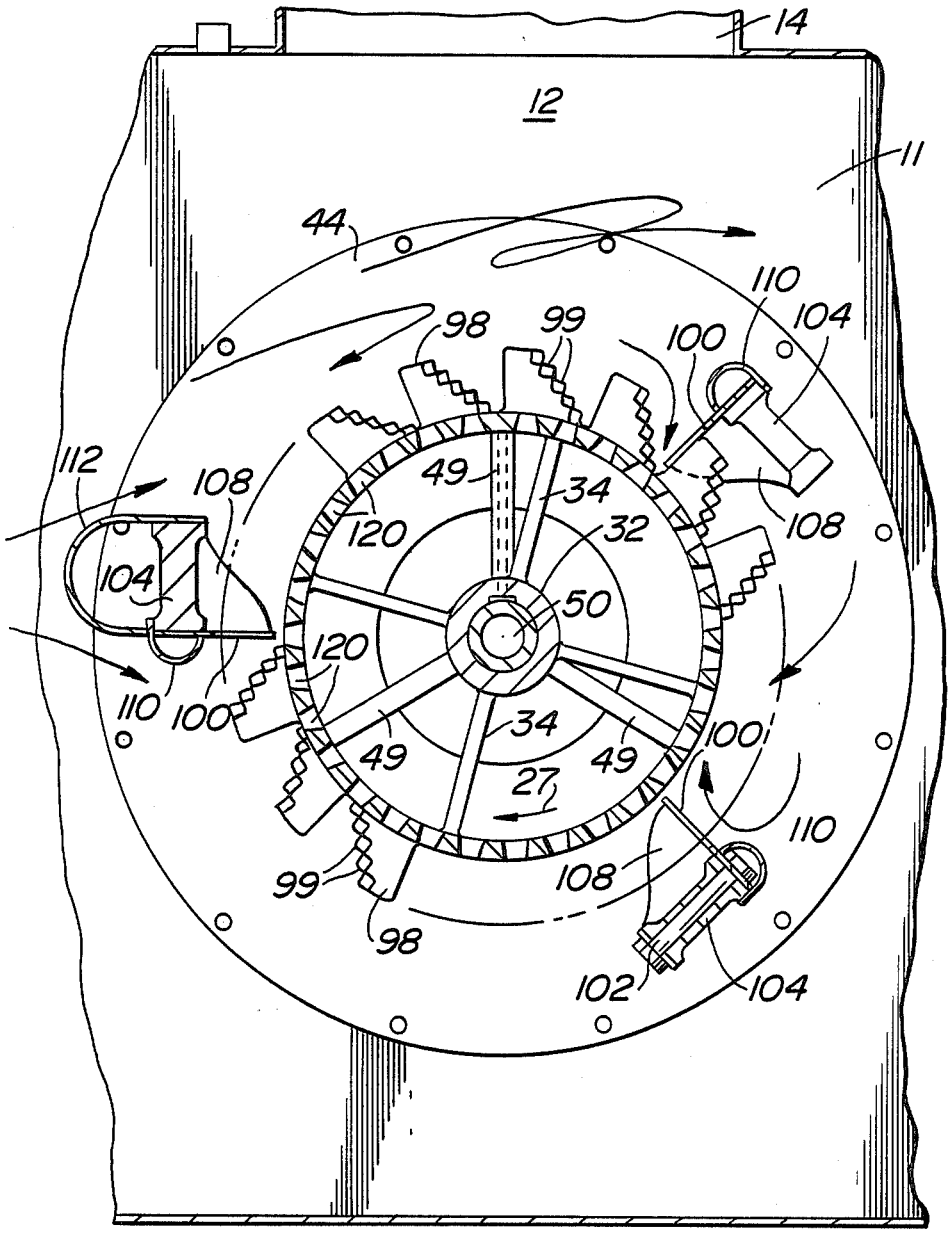
FIG. 5 is a section taken on line 5—5 of FIG. 2.

As shown by the arrow 27 in FIG. 5, hollow cylinder 26 rotates in a clockwise direction and each tooth 98 is in the form of a plurality of steps 99 extending along an inclination extending back from the direction of rotation of hollow cylinder 26. By this arrangement, each tooth 98 comes progressively into contact with a cutting blade 100 so as to produce a smooth cutting action. As shown in FIG. 7, each of the steps 99 is cut on an angle so that each step comes progressively into contact with cutting blade 100, which arrangement enhances the smooth cutting action.

As shown in FIG. 5, the three cutting blades 100 are spaced circumferentially equally around hollow cylinder 26. Each blade 100 comprises a flat strip secured by bolts 102 onto a support bracket 104 extending longitudinally across comminution chamber 12 and bolted at its ends on side plates 11 and 13. Each of the blades 100 is positioned to extend in a plane extending radially outwardly from the longitudinal axis of hollow cylinder 26 with its inner edge close to the outer wall of hollow cylinder 26. Each blade 100 is provided with eleven rectangular cutouts 106 aligned with the eleven circular rows of teeth 98 as shown in FIG. 2. Each support bar 104 is provided with reinforcing portions 108 located in back of the regions of each blade 100 between cutouts 106. Each blade 100 is provided with a rounded nose piece 110 facing the flow of liquid (shown by the arrows in FIG. 5) within comminution chamber 12 and serving to protect the parts from erosion and jamming by the solids containing liquid. Also, there is provided a large nose piece 112 on the blade support 104 adjacent inlet 22 to protect the blade parts against the wearing effects of the inflowing solids containing liquid at this location.

Hollow cylinder 26 is provided with a plurality of openings 120 equally distributed around the circumference thereof in locations between the circular rows of blades as is best shown in FIGS. 2 and 7. Openings 120 provide passages to the interior of hollow cylinder 26 for the solids comminuted in chamber 12 and are tapered to get larger in the direction of flow so as to prevent the solids from sticking in the openings 120. Thus, when the solids are reduced to a size smaller than the openings 120 they can flow from comminution chamber 12 into the interior of the hollow cylinder 26. The size of the openings 120 determines the size of the largest particles that can flow from comminution chamber 12 into the interior of hollow cylinder 26 for delivery to the irrigation location.

In the operation of the comminutor-pump assembly of the invention in a sewage irrigation system, the inlet means 22 to comminution chamber 12 is connected to a supply of sewage by suitable conduit means and the discharge of pump 60 is connected to a suitable irrigation spray means, such as sprinkler heads or a large spray gun. By connecting the input shaft 72 of gearbox 70 to a drive means such as the power take-off of a tractor or the like, pump 60 is made operative by the rotation of the pump shaft 66. As the pump shaft 66 is rotated, it will drive shaft extension 50 through coupling 58 to cause a corresponding rotation of gear 56 which, in turn, drives the planetary gear system 80 to cause rotation of hollow cylinder 26 at a reduced speed. As hollow cylinder 26 rotates, cutting teeth 98 pass through cutouts 106 in blades 100 to comminute the solid particles in comminution chamber 12. When the particles in comminution chamber 12 are reduced to a suitable small size, they will pass through the openings 120 in hollow cylinder 26 into the interior thereof and be drawn to the suction of pump 60. Pump 60 will draw liquid from the interior of hollow cylinder 26 and pump it through its discharge, the check valve means 61, and the discharge conduit 63 to the irrigation spray means. The continued operation of pump 60 serves to draw liquid through the inlet means 22.

In the event that a stone or other solid particle becomes jammed between the teeth 98 and a blade 100, the rotating gear 56 will cause planetary gear system 80 to rotate gear 90 and output shaft 38 engaged therewith so as to break the shear pins 94. In this manner, the pump 60 will continue to operate as will the planetary gear system 80 with the sun gear 90 continuing to rotate freely. At the same time the hollow cylinder 26 may remain stationary in the jammed position without breaking any of the cutting teeth 98 or associated parts.

Figure 9:
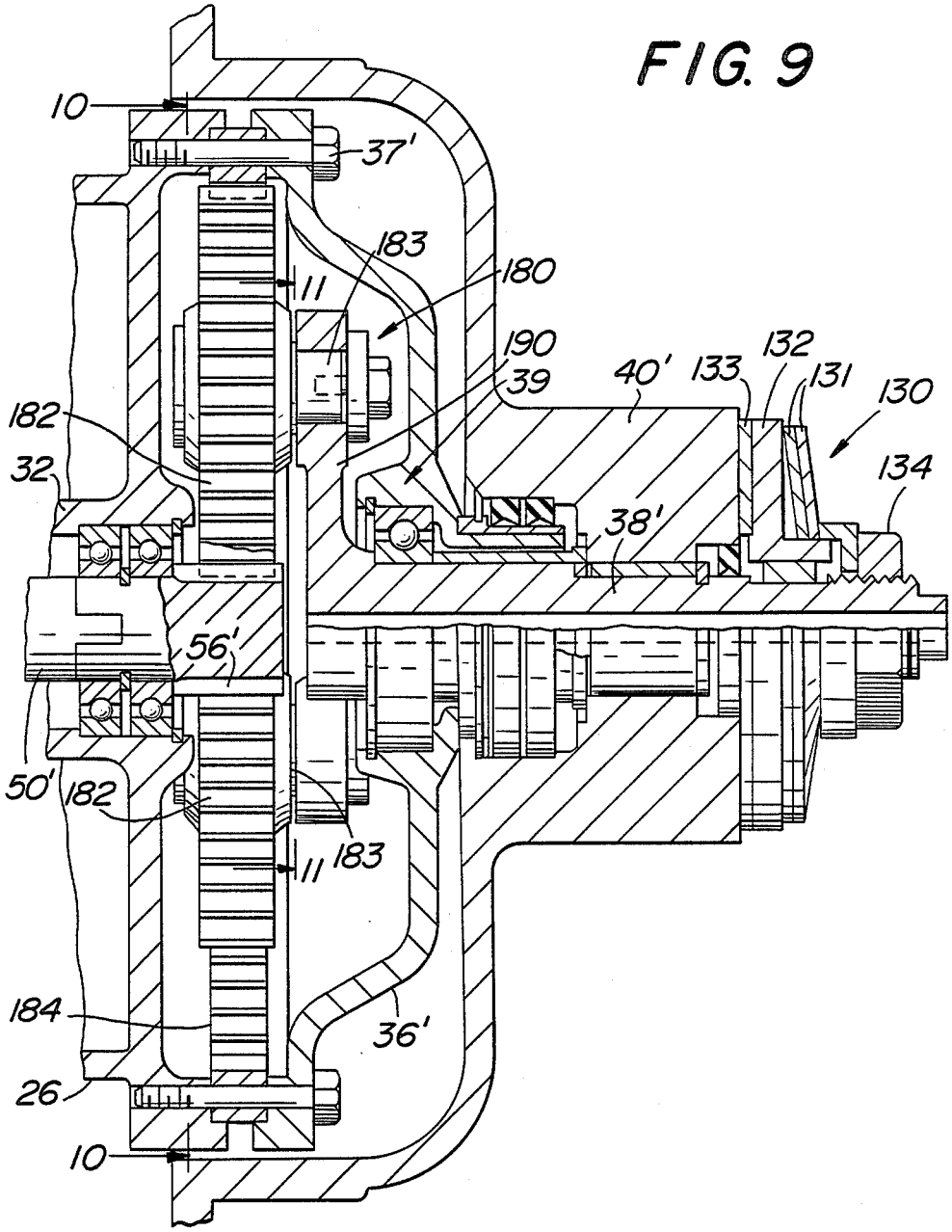
FIG. 9 is a sectional view showing a clutch arrangement and a planetary gear system that may be used in the comminutor-pump assembly shown in FIG. 1.

In FIGS. 9–11 there is shown another embodiment of the invention comprising a clutch means 130 and an alternate type of planetary gear system 180. Clutch means 130 provides the same function as the shear pin arrangement shown in FIG. 2 and planetary gear system 180 provides the same function as the planetary gear system 80 in the embodiment shown in FIGS. 1–8. In FIGS. 9–11 parts corresponding to equivalent parts of the embodiment of FIGS. 1–8 have been given like reference numerals with primes added.

Clutch means 130 is a spring-biased clutch arrangement comprising a plurality of conical washers (known as Belleville washers) forming a spring means 131 positioned in compression between a circular disc 132 keyed to the output shaft 38' of planetary gear system 180 and a backing member adjusting nut 134 secured to the end of shaft 38'. A brake liner type friction washer 133 is positioned between disc 132 and the end support 40'. Springs 131 provide a very substantial force urging disc 132 and washer 133 into frictional engagement with the end wall of end support 40' thereby holding shaft 38', which is keyed to disc 132, against rotational movement. Shaft 38' can be rotated if it has applied thereto a rotational force greater than the frictional force being applied by the spring discs 131 of the clutch means 130. The clutch means 130 is a typical spring-biased friction clutch and operates in a conventional manner.

Planetary gear system 180 is contained within the chamber defined by drum cover 36' and is responsive to the rotation of shaft extension 50' to cause hollow cylinder 26 to rotate at a reduced speed. To this end, planetary gear system 180 comprises a central pinion gear 56' engaged on the end of shaft extension 50' and three large planet gears 182 engaged with gear 56' at equally spaced circumferencial locations thereof (FIG. 10). Gears 182 are rotatably mounted on stationary pins 183 which are fixedly mounted on a spider portion 190 formed on the end of the normally stationary output shaft 38' of planetary gear system 180. Planet gears 182 are supported so as to engage the internal teeth of a ring gear 184 which is mounted for rotation with rotating cylinder 26 and drum cover 36'. As shown in FIG. 9, ring gear 184 is secured between the closed end of cylinder 26 and the inner end of drum cover 36' by mounting bolts 37'.

In operation, planetary gear system 180, in response to rotation of sun gear 56' by shaft extension 50', causes planet gears 182 to rotate on their pins 183 whereby ring gear 184 is caused to revolve around central pinion gear 56'. This movement of ring gear 184 causes a corresponding movement of rotating cylinder 26 and drum cover 36'. To illustrate, with gears 56' and 182 rotating in the direction of the arrows in FIG. 10, ring gear 184 moves in a counterclockwise direction as viewed in FIG. 10 causing a corresponding rotation of hollow cylinder 26.

As described above, it is the rotation of hollow cylinder 26 that provides the movement for producing the comminution of the solids in the sewage. In the event that the rotating cylinder 26 becomes jammed, the rotating central pinion gear 56' will cause the planetary gear system 180 to drive the normally stationary output shaft 38' to cause rotation thereof. As was discussed above, the clutch means 130 operates to permit this rotation of output shaft 38'. It will be apparent that in the jammed position of the device, the ring gear 184 remains stationary while the planet gears 182 and pins 183 are caused to revolve around the axis of gear 56' thereby causing rotation of output shaft 38'.

It will be apparent that various changes may be made in the construction and arrangement and arrangement of parts without departing from the scope of the invention.

I claim:

1. A comminutor-pump assembly comprising:

a housing defining a comminution chamber and having an inlet for a solids containing liquid, a comminutor drum including a hollow cylinder having a cylindrical wall defining exterior and interior surfaces, an interior chamber enclosed by said interior surface of said cylindrical wall, means mounting said cylinder to extend within said comminution chamber with its longitudinal axis extending horizontally and for rotation about its longitudinal axis, one end of said cylinder being open, means closing the end of said cylinder opposite said one end, a plurality of cutting teeth on the exterior surface of said cylindrical wall, a plurality of blades extending within said comminution chamber on the exterior of said cylinder for cooperating with said cutting teeth so as to comminute solids within said chamber, a plurality of openings in said cylindrical wall of said cylinder through which comminuted solids of a predetermined size may pass into said interior chamber of said cylinder, a pump mounted on said housing adjacent to the open end of said cylinder, said pump having a suction through which liquid is drawn into the pump, the suction of said pump being in flow communication with said interior chamber of said cylinder, and drive means for causing rotation of siad pump and rotation of said cylinder to cause said solids and the liquid to be drawn into the comminution chamber through said inlet, the comminution of solids by said teeth, and the passage of comminuted solids through said openings into said interior chamber of said cylinder from which they flow to the suction of the pump and are discharged therefrom.

2. A comminutor-pump assembly according to claim 1 wherein said drive means includes a pump drive shaft, an extension from said pump drive shaft through the interior of said cylinder and through the closed end thereof, and gear means engaged with said extension for causing rotation of said cylinder along with said pump drive shaft.

3. A comminutor-pump assembly according to claim 2 wherein said gear means comprises a planetary gear system for causing said cylinder to rotate at a lower speed than said pump.

4. A comminutor-pump assembly according to claim 3 wherein said planetary system comprises a plurality of planet gears mounted adjacent said closed end of said cylinder for causing rotation of said cylinder.

5. A comminutor-pump assembly according to claim 4 including a ring gear mounted for rotation with said cylinder.

6. A comminutor-pump assembly according to claim 4 comprising an output shaft in engagement with said planetary gear system means for holding said output shaft against rotation, said holding means comprising means responsive to a jamming of said cylinder for releasing said output shaft to permit rotation thereof.

7. A comminutor-pump assembly according to claim 6 wherein said releasing means comprises a shear pin means engaged with said output shaft.

8. A comminutor-pump assembly according to claim 6 wherein said releasing means comprises clutch means in engagement with said output shaft.

9. A comminutor-pump assembly according to claim 2 wherein said gear means are mounted externally of said interior chamber of cylinder and adjacent to said closed end of said hollow cylinder, and including means enclosing said gear means to seal it from contact with any contents of said comminution chamber.

10. A comminutor-pump assembly according to claim 1 wherein said pump has a discharge through which liquid is discharged therefrom, and including means for connecting said discharge of said pump to an irrigation spray means having nozzle openings of a predetermined size, and wherein the openings in said hollow cylinder are smaller than said nozzle openings.

11. A comminutor-pump assembly according to claim 1 wherein each of said cutting teeth extends radially outwardly from the exterior surface of said cylindrical wall and is constructed and arranged as a plurality of steps extending on an angle so that each tooth comes into contact with one of said blades progressively.

12. A comminutor-pump assembly according to claim 11 wherein each of said blades comprises a straight blade extending straight across said exterior surface of said cylindrical wall, and along the exterior of said cylinder in a plane extending radially outwardly from the longitudinal axis of said cylinder, said blades having a plurality of longitudinally spaced apart cutouts therein through which said cutting teeth move as the cylinder rotates.

13. A comminutor-pump assembly according to claim 1 including a pump inlet adapter mounted on a side wall of said housing, said pump being mounted on a side of said pump inlet adapter facing the outside of said housing, and means for rotatively supporting said open end of said hollow cylinder on a side of said pump inlet adapter facing the inside of said housing.

14. comminutor-pump assembly according to claim 1 wherein said drive means comprises a single prime mover and is constructed and arranged to cause rotation of said pump and said cylinder at different rotational speeds.

* * * * *